US006853150B2

(12) United States Patent
Clauberg et al.

(10) Patent No.: US 6,853,150 B2
(45) Date of Patent: Feb. 8, 2005

(54) LIGHT EMITTING DIODE DRIVER

(75) Inventors: Bernd Clauberg, Schaumburg, IL (US); Robert A. Erhardt, Schaumburg, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/037,490

(22) Filed: Dec. 28, 2001

(65) Prior Publication Data

US 2003/0122502 A1 Jul. 3, 2003

(51) Int. Cl.[7] ..... H01B 37/00; H01B 37/02

(52) U.S. Cl. ..... 315/185 R; 315/244; 315/291

(58) Field of Search ..... 315/185 R, 186, 315/192, 242, 244, 209 R, 185 S, 217, 224, 216, 243, 291; 345/39, 46, 82, 83; H05B 37/00, 37/02

(56) References Cited

U.S. PATENT DOCUMENTS

| | | | | |
|---|---|---|---|---|
| 3,676,735 A | | 7/1972 | Roche | 315/207 |
| 4,977,351 A | * | 12/1990 | Bavaro et al. | 315/87 |
| 5,287,372 A | * | 2/1994 | Ortiz | 372/38.07 |
| 5,323,305 A | * | 6/1994 | Ikeda et al. | 363/98 |
| 5,459,478 A | * | 10/1995 | Bolger et al. | 345/46 |
| 5,736,881 A | * | 4/1998 | Ortiz | 327/175 |
| 5,802,031 A | | 9/1998 | Clark et al. | 369/59 |
| 5,936,599 A | * | 8/1999 | Reymond | 345/82 |
| 6,285,140 B1 | * | 9/2001 | Ruxton | 315/312 |
| 6,310,445 B1 | * | 10/2001 | Kashaninejad | 315/291 |
| 6,359,392 B1 | * | 3/2002 | He | 315/291 |
| 6,411,045 B1 | * | 6/2002 | Nerone | 315/291 |
| 2003/0043611 A1 | * | 3/2003 | Bockle et al. | 363/131 |

FOREIGN PATENT DOCUMENTS

| | | | | |
|---|---|---|---|---|
| DE | 10013207 A | * | 9/2001 | H05B/37/02 |
| EP | 1215944 A1 | | 6/2002 | H05B/33/08 |
| JP | 58-188170 | | 11/1983 | H01L/33/00 |
| JP | 11-330561 | | 11/1999 | H01L/33/00 |
| WO | WO 98/02020 | | 1/1998 | H05B/43/00 |
| WO | WO 99/23497 | | 5/1999 | G01R/19/15 |
| WO | WO 01/01385 A1 | * | 1/2001 | G09G/3/36 |

* cited by examiner

*Primary Examiner*—Don Wong
*Assistant Examiner*—Trinh Vo Dinh

(57) ABSTRACT

A LED driver includes a high frequency inverter and an impedance circuit. The high frequency inverter operates to produce a high frequency voltage source whereby the impedance circuit directs a flow of alternating current through a LED array including one or more anti-parallel LED pairs, one or more anti-parallel LED strings, and/or one or more anti-parallel LED matrixes. A transistor can be employed to divert the flow of the alternating current from the LED array, or to vary the flow of the alternating current through LED array.

28 Claims, 8 Drawing Sheets

LIGHT EMITTING DIODE DRIVER

BACKGROUND OF THE INVENTION

1. Field of the Invention

The present invention generally relates to light emitting diode ("LED") arrays. The present invention specifically relates to a LED array powered by an alternating current supplied by a high frequency inverter circuit, and LED arrays controlled by impedance array that may be switching to accomplish dimming and switching functions.

2. Description of the Related Art

LEDs are semiconductor devices that produce light when a current is supplied to them. LEDs are intrinsically DC devices that only pass current in one polarity and historically have been driven by DC voltage sources using resistors to limit current through them. Some controllers operate devices in a current control mode that is compact, more efficient than the resistor control mode, and offers "linear" light output control via pulse width modulation. However, this approach only operates one array at a time and can be complex.

LEDs can be operated from an AC source if they are connected in an "anti-parallel" configuration as shown by patents WO98/02020 and JP11/330561. Such operation allows for a simple method of controlling LED arrays but which operate from a low frequency AC line. However, this approach employs large components and no provision is given for controlling the light output.

The present invention addresses the problems with the prior art.

SUMMARY OF THE INVENTION

The present invention is a light emitting diode driver. Various aspects of the present invention are novel, non-obvious, and provide various advantages. While the actual nature of the present invention covered herein can only be determined with reference to the claims appended hereto, certain features, which are characteristic of the embodiments disclosed herein, are described briefly as follows.

One form of the invention is a LED driver comprising a LED array, an inverter, and an impedance circuit. The LED array has an anti-parallel configuration. The inverter is operable to provide an alternating voltage at a switching frequency. The impedance circuit is operable to direct a flow of an alternating current through said LED array in response to the alternating voltage. In one aspect, the impedance circuit includes a capacitor and the LED array includes an anti-parallel LED pair, an anti-parallel LED string and/or anti-parallel LED matrix coupled in series to the capacitor. In another aspect, a transistor is coupled in parallel to the LED array with the transistor being operable to control (e.g., varying or diverting) the flow of the alternating current through the LED array.

The foregoing form as well as other forms, features and advantages of the present invention will become further apparent from the following detailed description of the presently preferred embodiments, read in conjunction with the accompanying drawings. The detailed description and drawings are merely illustrative of the present invention rather than limiting, the scope of the present invention being defined by the appended claims and equivalents thereof.

DETAILED DESCRIPTION OF THE PRESENTLY PREFERRED EMBODIMENTS

Figure 1:
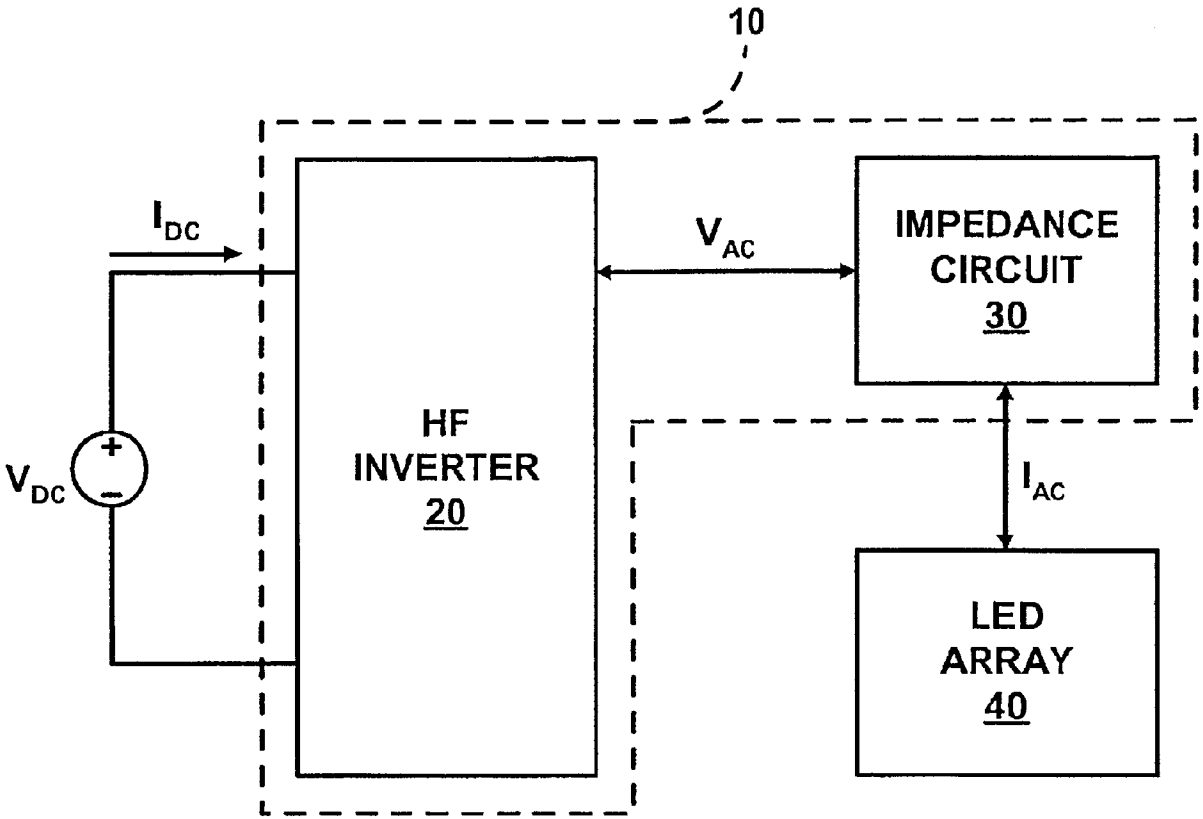
FIG. 1 illustrates a block diagram of a LED driver in accordance with the present invention.

FIG. 1 illustrates a LED driver 10 in accordance with the present invention for driving a LED array 40. LED driver 10 comprises a high frequency ("HF") inverter 20, and an impedance circuit 30. In response to a direct current $I_{DC}$ front a direct voltage source $V_{DC}$. HF inverter 20 communicates an alternating voltage $V_{AC}$ at a switching frequency (e.g. 20 kHz to 100 kHz) to impedance circuit 30, which in turn communicates an alternating currant $I_{AC}$ to LED array 40. HF inverter 20 allows a compact and efficient method to control the current to LED array 40. At high frequencies, the current limiting components become compact in size. HF inverter 20 also allows for an efficient current control from direct voltage source $V_{DC}$. Forms of HF inverter 20 include, but are not limited to, a voltage fed half bridge, a current fed half bridge, and a current fed push pull. Techniques known in the art can be employed to use frequency modulation to control output current which can be implemented to further improve the regulation of the proposed invention.

Figure 2:
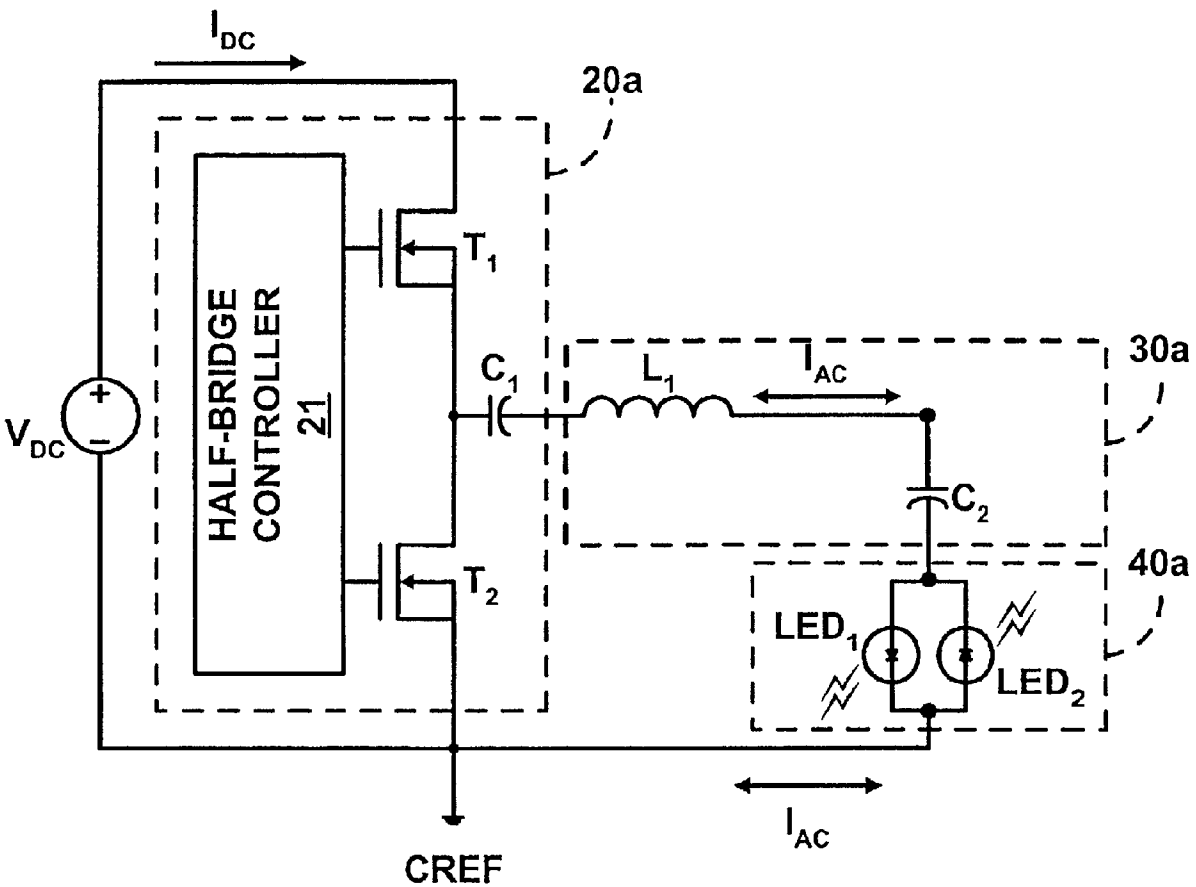
FIG. 2 illustrates a first embodiment of the LED driver of FIG. 1 in operation with a first embodiment of a LED array in accordance with the present invention.

FIG. 2 illustrates a first embodiment of LED driver 10 (FIG. 1) in accordance with the present invention. A HF inverter 20*a* includes a half-bridge controller 21 for controlling a half-bridge consisting of a transistor $T_1$ and a transistor $T_2$ in the form of MOSFETs. HF inverter 20*a* conventionally activates and deactivates transistor $T_1$ and transistor $T_2$ in an alternating inverse manner to produce a DC pulsed voltage (not shown) between transistor $T_1$ and transistor $T_2$. The DC pulsed voltage is dropped across a capacitor $C_1$ to produce a voltage square wave (not shown) to an impedance circuit 30*a*.

An impedance circuit 30*a* includes an inductor $L_1$ and a capacitor $C_2$ coupled to capacitor $C_1$ in series. Inductor $L_1$ and capacitor $C_2$ direct a flow of alternating current $I_{AC}$ through a LED array 40*a* having a light emitting diode $LED_1$ and a light emitting diode $LED_2$ coupled in anti-parallel (i.e., opposite polarizations). Alternating current $I_{AC}$ flows through light emitting diode $LED_1$ when alternating current $I_{AC}$ is in a positive polarity. Alternating current $I_{AC}$ flows through light emitting diode $LED_2$ when alternating current $I_{AC}$ is in a negative polarity. Impedance elements $L_1$ and $C_2$ are connected with light emitting diode $LED_1$ and light emitting diode $LED_2$ in a "series resonant, series loaded" configuration. In this configuration, circulating current can be minimized and "zero voltage switching" of transistor $T_1$ and transistor $T_2$ can be realized resulting in an efficient and compact circuit.

A further benefit of this configuration is the ability to vary the current through the LEDs by varying the frequency of the half bridge. In such a configuration as frequency increases, current through the LEDs will generally decrease and as frequency decreases, current will increase. If a frequency control is added to the half bridge, variable light output from the LEDs can be realized.

Figure 3:
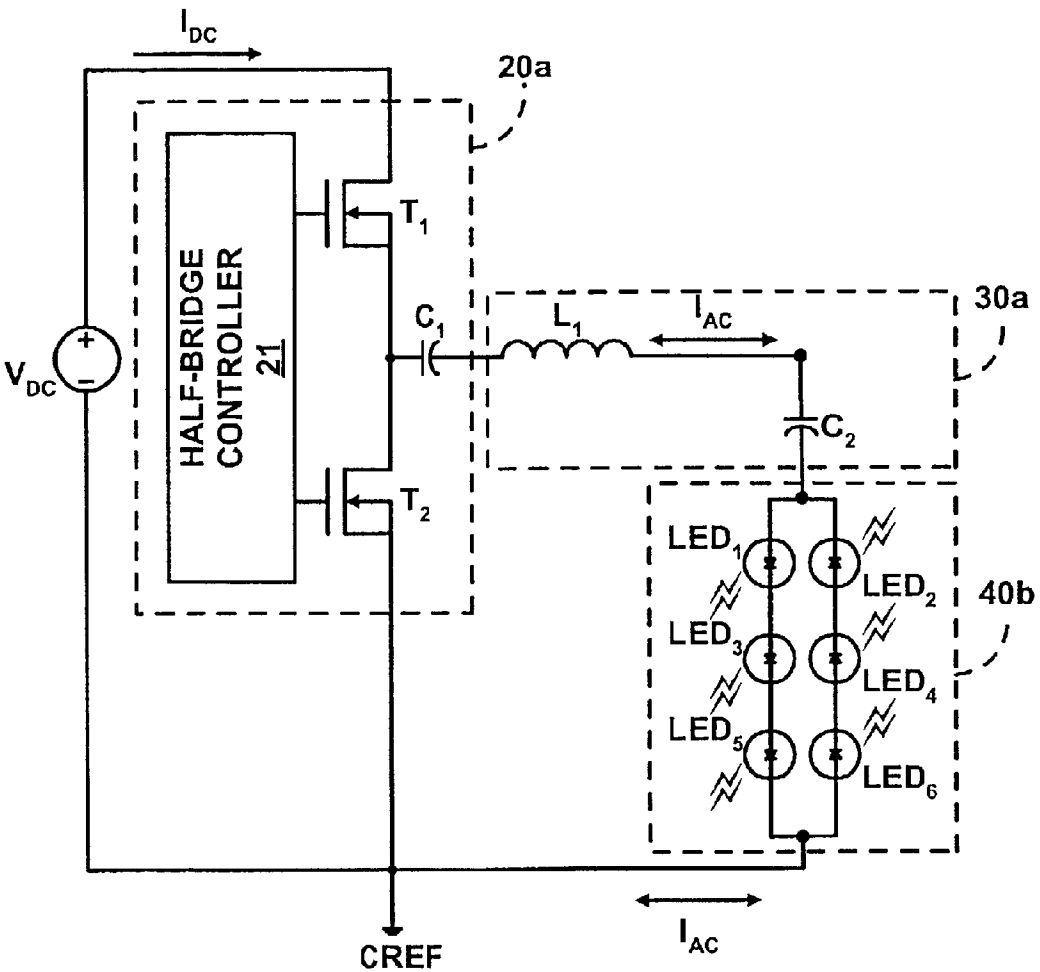
FIG. 3 illustrates the LED driver of FIG. 1 in operation with a second embodiment of a LED array in accordance with the present invention.

FIG. 3 illustrates HF inverter 20*a* (FIG. 2) and impedance circuit 30*a* (FIG. 2) driving an LED array 40*b* having LED strings in place of single LEDs connected in "anti-parallel"_configuration. Alternating current $I_{AC}$ flows through a light emitting diode $LED_1$, a light emitting diode $LED_3$ and a light emitting diode $LED_5$ when alternating current $I_{AC}$ has a positive polarity. Conversely, alternating current $I_{AC}$ flows through a light emitting diode $LED_2$, a light emitting diode $LED_4$ and a light emitting diode $LED_6$ when alternating current $I_{AC}$ has a negative polarity. In alternative embodiments, the LED strings can have differing numbers of LEDs in series as requirements warrant and may be connected in electrically equivalent configurations or in "matrix"_configuration"as would be known by those skilled in the art.

Figure 4:
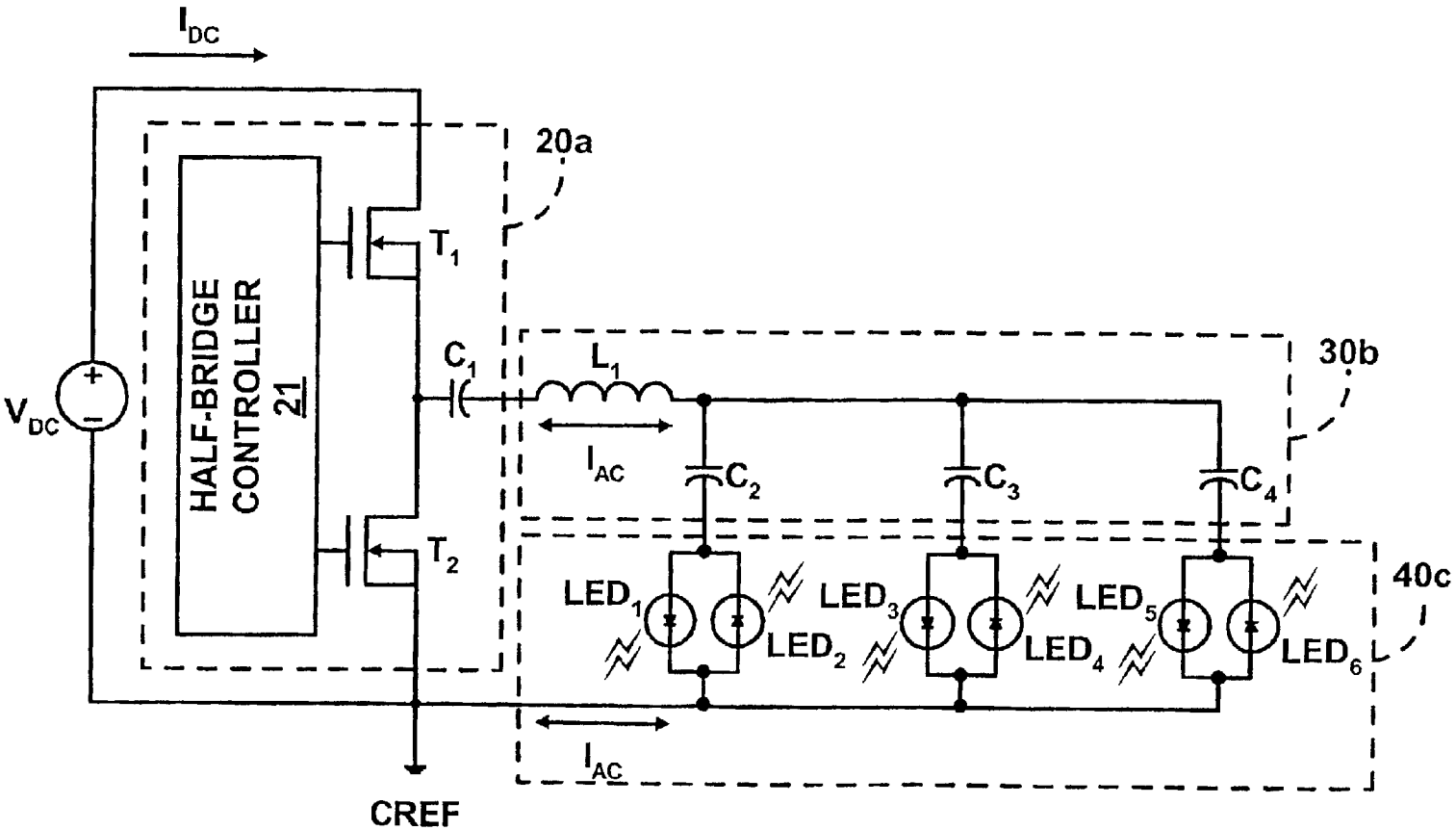
FIG. 4 illustrates a second embodiment of the LED driver of FIG. 1 in operation with a third embodiment of a LED array in accordance with the present invention.

FIG. 4 illustrates a second embodiment of LED driver 10 (FIG. 1). An impedance circuit 30*b* includes inductor $L_1$ coupled in series to a parallel coupling of capacitor $C_2$, a capacitor $C_3$ and a capacitor $C_4$. Impedance circuit 30*b* directs a flow of alternating current $I_{AC}$ through LED array 40*c*. An anti-parallel coupling of light emitting diode $LED_1$ and light emitting diode $LED_2$ is coupled in series with capacitor $C_2$. An anti-parallel of coupling light emitting diode $LED_3$ and light emitting diode $LED_4$ is coupled in series with capacitor $C_3$. An anti-parallel coupling of light emitting diode $LED_5$ and light emitting diode $LED_6$ is coupled in series with capacitor $C_4$. Divided portions of alternating current $I_{AC}$ flow through light emitting diode $LED_1$, light emitting diode $LED_3$ and light emitting diode $LED_5$ when alternating current $I_{AC}$ is in a positive polarity. Divided portions of alternating current $I_{AC}$ flow through light emitting diode $LED_2$, light emitting diode $LED_4$ and light emitting diode $LED_6$ when alternating current $I_{AC}$ is in a negative polarity. The capacitance values of capacitor $C_2$, capacitor $C_3$ and capacitor $C_4$ are identical whereby alternating current $I_{AC}$ is divided equally among the anti-parallel LED couplings.

Capacitor C2, capacitor C3, and capacitor C4 can be low cost and compact surface mounted type capacitors and may be mounted directly to LED array 40*c* as a subassembly. By driving pairs of LEDs in this manner, the driving scheme has the advantage that if one LED fails "open" only one pair of LEDs will go dark as opposed to a whole string as can be the case with other driving schemes. While LED array 40*c* is shown to consist of three pairs of anti-parallel connected LEDs one skilled in the art can see that anti-parallel connected LED "strings" as illustrated in FIG. 3 could also be connected in the same fashion as could any number of LED pairs/strings/matrixes with a corresponding number of current splitting capacitors. Furthermore, differing levels of current desired in different LED pairs/strings/matrixes can be accomplished by choosing capacitor values of different capacitance inversely proportional to the ratio of current desired.

Figure 5:
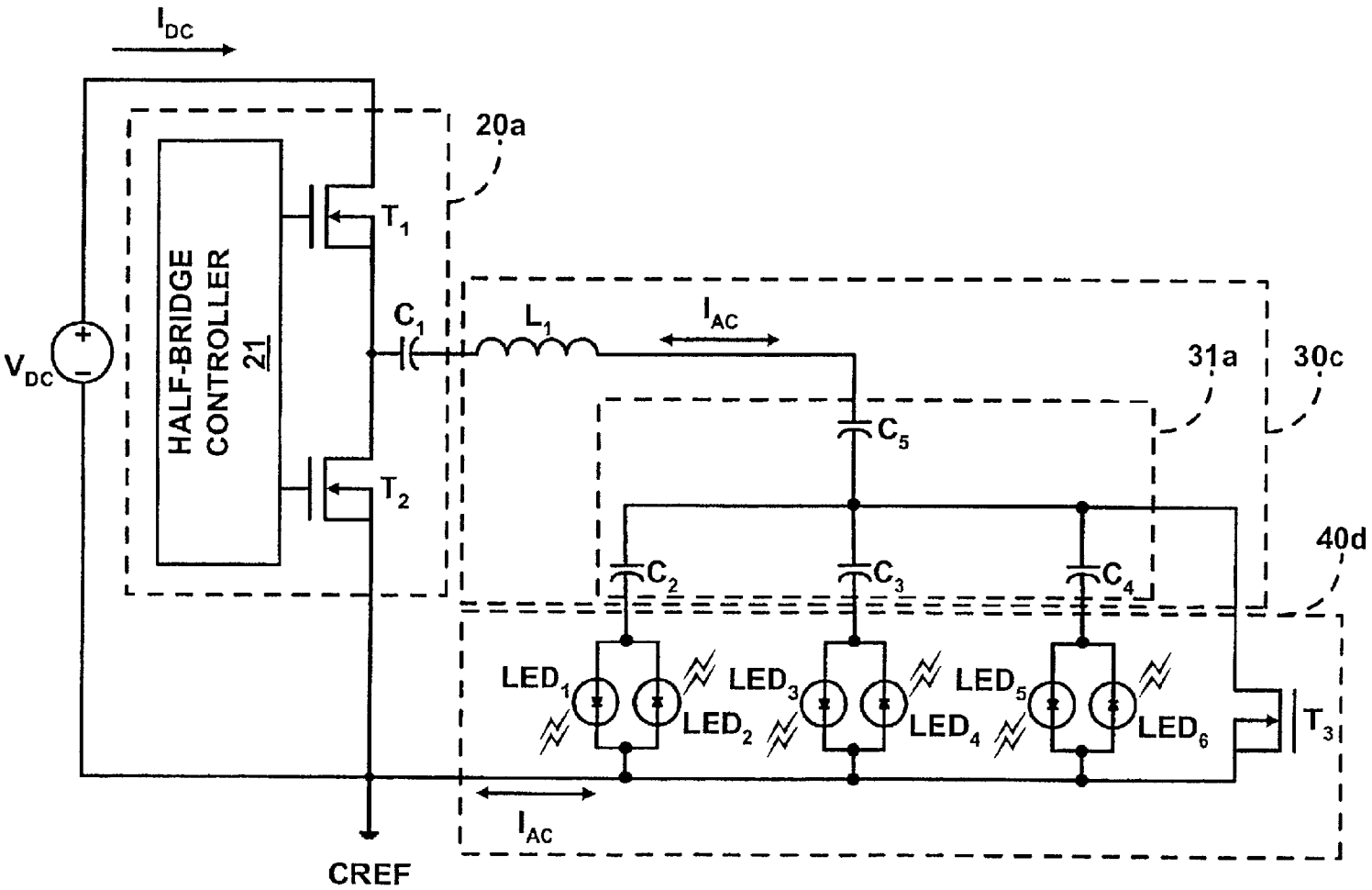
FIG. 5 illustrates the second embodiment of the LED driver of FIG. 1 in operation with a fourth embodiment of a LED array in accordance with the present invention.

FIG. 5 illustrates a third embodiment of LED driver 10 (FIG. 1). An impedance circuit 30*c* includes inductor $L_1$ coupled in series to a capacitor $C_5$, which is coupled in series to a parallel coupling of capacitor $C_2$, capacitor $C_3$ and capacitor $C_4$. Impedance circuit 30*c* directs a flow of alternating current $I_{AC}$ through LED array 40*d*. An anti-parallel coupling of light emitting diode $LED_1$ and light emitting diode $LED_2$ is coupled in series with capacitor $C_2$. An anti-parallel of coupling light emitting diode $LED_3$ and light emitting diode $LED_4$ is coupled in series with capacitor $C_3$. An anti-parallel coupling of light emitting diode $LED_5$ and light emitting diode $LED_6$ is coupled In series with capacitor $C_4$. A switch in the form of a transistor $T_3$ is coupled in parallel to the anti-parallel LED couplings. Those having ordinary skill in the art will appreciate other forms of switches that may be substituted for transistor $T_3$.

Divided portions of alternating current $I_{AC}$ can flow through light emitting diode $LED_1$, light emitting diode $LED_3$ and light emitting diode $LED_5$ when alternating current $I_{AC}$ is in a positive polarity. Divided portions of alternating current $I_{AC}$ can flow through light emitting diode $LED_2$, light emitting diode $LED_4$ and light emitting diode $LED_5$ when alternating current $I_{AC}$ is in a negative polarity. The capacitance values of capacitor $C_2$, capacitor $C_3$ and capacitor $C_4$ can be proportioned to divide the alternating current $I_{AC}$ into whatever ratios are desired for the individual LED pairs. An operation of transistor $T_3$ serves to divert alternating current $I_{AC}$ from the anti-parallel LED couplings to thereby turn the LEDs off. Capacitor $C_5$ is included in this representation to minimize the effective impedance change seen by the half bridge 20*a* and hence the change in current level $I_{AC}$ when transistor $T_3$ is switched on and off, but the circuit can also operate with a series resonant capacitance made up of only capacitor $C_2$, capacitor $C_3$ and capacitor $C_4$. It is also possible to substitute LED strings as represented in FIG. 3 or matrix connections of LEDs in place of the LED pairs.

While three LED pairs and capacitors are shown in this representation for demonstration purposes, those skilled in the art will appreciate that any number at LED pairs, LED strings, and/or LED matrices can be used with suitable capacitors and drive from the half bridge 20*a* and can be switched with transistor $T_3$.

Figure 6:
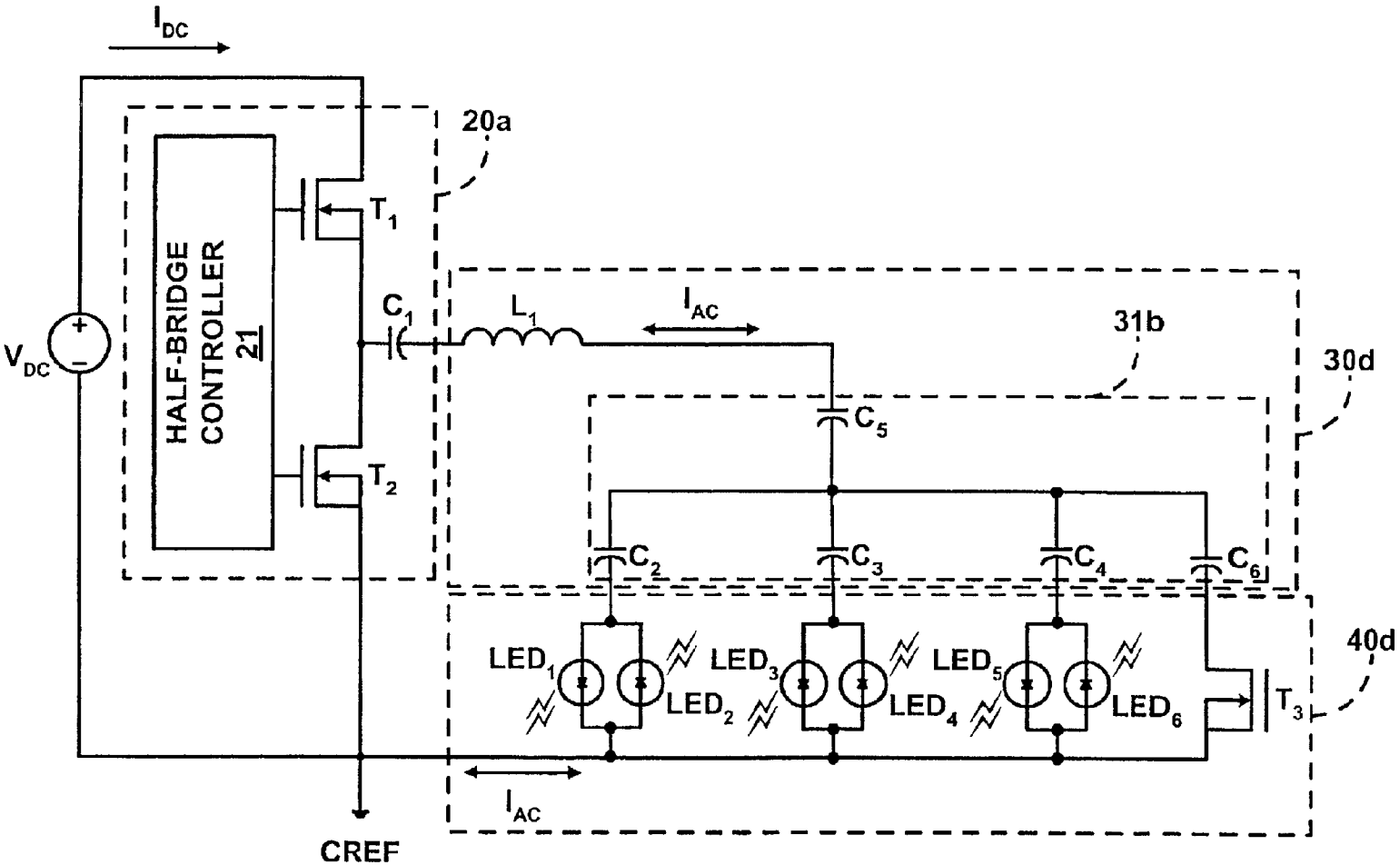
FIG. 6 illustrates a third embodiment of the LED driver of FIG. 1 in operation with a fifth embodiment of a LED array in accordance with the present invention.

FIG. 6 illustrates a fourth embodiment of LED driver 10 (FIG. 1). An impedance circuit 30*d* includes inductor $L_1$ coupled in series to a capacitor $C_5$, which is coupled in series to a parallel coupling of capacitor $C_2$, capacitor $C_3$, capacitor $C_4$ and capacitor $C_6$. Impedance circuit 30*d* directs a flow of alternating current $I_{AC}$ through of LED array 40*d*. An anti-parallel coupling of light emitting diode $LED_1$ and light emitting diode $LED_2$ is coupled in series with capacitor $C_2$. An anti-parallel of coupling light emitting diode $LED_3$ and light emitting diode $LED_4$ is coupled in series with capacitor $C_3$. An anti-parallel coupling of light emitting diode $LED_5$ and light emitting diode $LED_6$ is coupled in series with capacitor $C_4$. Transistor $T_3$ is coupled series to capacitor $C_6$.

Divided portions of alternating current $I_{AC}$ can flow through light emitting diode $LED_1$, light emitting diode $LED_3$ and light emitting diode $LED_5$ when alternating current $I_{AC}$ is in a positive polarity. Divided portions of alternating current $I_{AC}$ can flow through light emitting diode $LED_2$, light emitting diode $LED_4$ and light emitting diode $LED_6$ when alternating current $I_{AC}$ is in a negative polarity. The capacitance values of capacitor $C_2$, capacitor $C_3$ and capacitor $C_4$ can be proportioned to divide the alternating current $I_{AC}$ into whatever ratios are desired for the individual LED pairs. An operation of transistor $T_3$ serves to reduce the ampere level of the divided portions of alternating current $I_{AC}$ through the anti-parallel LED coupling by diverting current via capacitor $C_5$.

It is also possible to substitute LED strings as represented in FIG. 3 or LED matrixes connections in place of the LED pairs.

While three LED pairs and capacitors are shown in this representation for demonstration purposes, those skilled in the art will appreciate that any number of LED pairs, LED strings, or LED matrices can be used with suitable capacitors and drive from the half bridge 20*a* and that the amplitude of current through these can be switched with transistor $T_3$ and suitable capacitance $C_6$.

Those having ordinary skill in the art will further appreciate that multiple levels of illumination can be realized for a given LED array through the use of combinations of switching schemes demonstrated in FIGS. 5 and 6, and through the use of multiple switches and capacitors configured as in FIG. 6. If additional capacitors and switches are configured as taught by $C_6$ and $T_3$ of FIG. 6, then multiple illumination levels can be accomplished. If a switching transistor is added as taught by transistor $T_3$ from FIG. 5, an on/off function can be added as well.

In alternative embodiments, further "linear" dimming control could be added to either of the configurations as taught by FIGS. 5 and 6 if transistor $T_3$ in either of them were to be switched in a "pulse width modulated" fashion. If transistor $T_3$ were switched in such a manner, light output could be controlled linearly from the maximum and minimum levels determined by "full on" and "full off" states of the transistor $T_3$ through all light levels in between as a function of the duty cycle of the on time of the transistor $T_3$.

Figure 7:
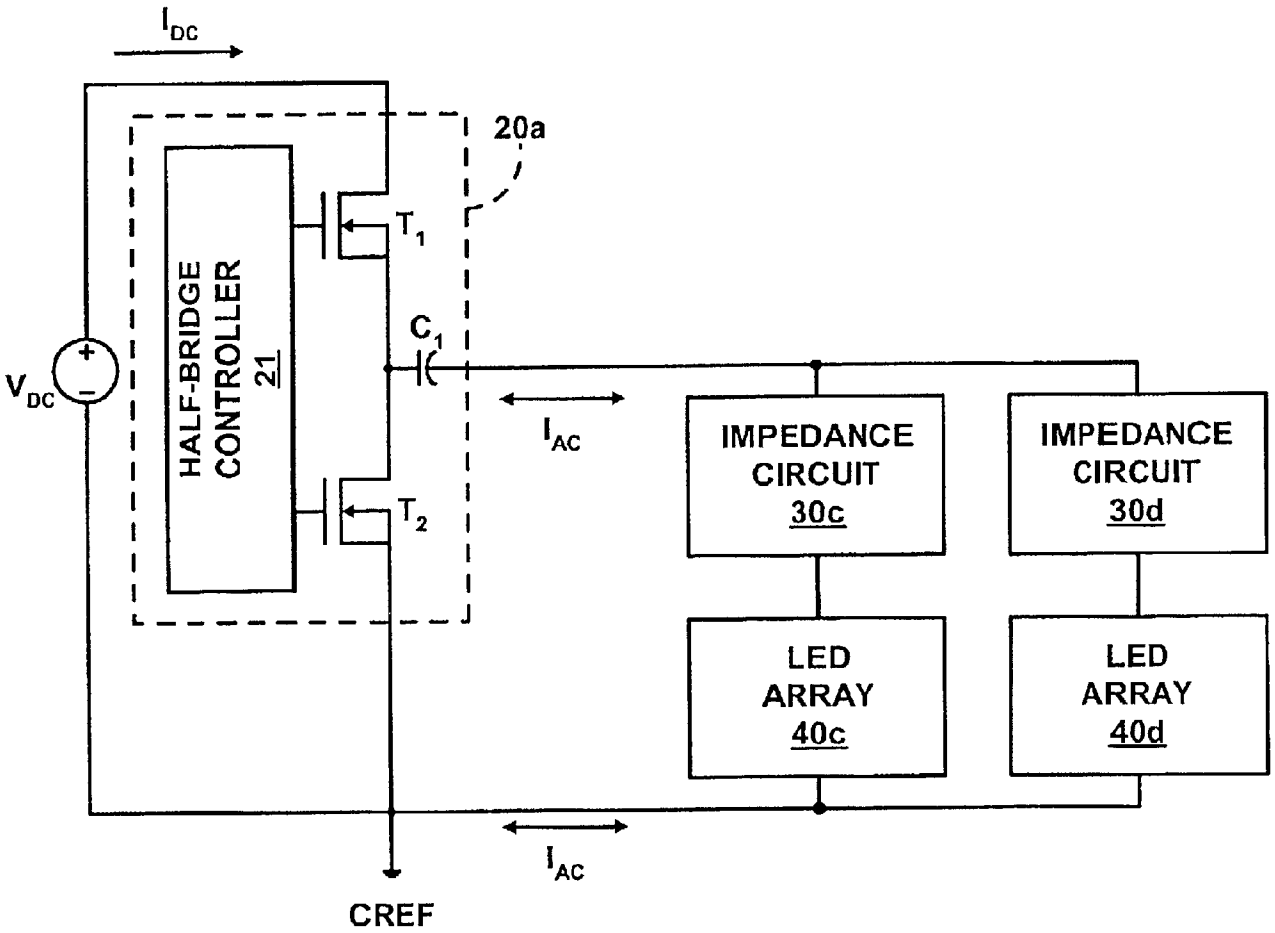
FIG. 7 illustrates a first embodiment of an illumination system in accordance with the present invention.

FIG. 7 illustrates a first embodiment of an illumination system in accordance with the present invention that combines on/off switching features as demonstrated in FIG. 5 with amplitude control features as demonstrated in FIG. 6. An automobile rear lighting system is an example of an application for such a requirement. In an automobile rear lighting system, an on/off requirement is used for the turn signal function and two levels of light output are used for the tail light and brake light functions.

HF inverter 20, impedance circuit 30*c*, and LED array 40*d* constitutes a turn signaling device whereby an operation of transistor $T_3$ as previously described herein in connection with FIG. 5 facilitates a flashing emission of light from LED array 40*d*. HF inverter 20, impedance circuit 30*d*, and LED array 40*d* constitutes a brake signaling device whereby an operation of transistor $T_3$ as previously described herein in connection with FIG. 6 facilitates an alternating bright/dim emission of light from LED array 40*d*. In this manner, a single half bridge driving stage can be used to control two sets of LEDs independently of each other with varying degrees of illumination.

While FIG. 7 is shown demonstrating one half bridge operating two sets of LED arrays, those having ordinary skill in the art will appreciate that any number of arrays of varying configuration can be connected and operated independently of each other through the control schemes shown the accompanying figures and previously described.

Figure 8:
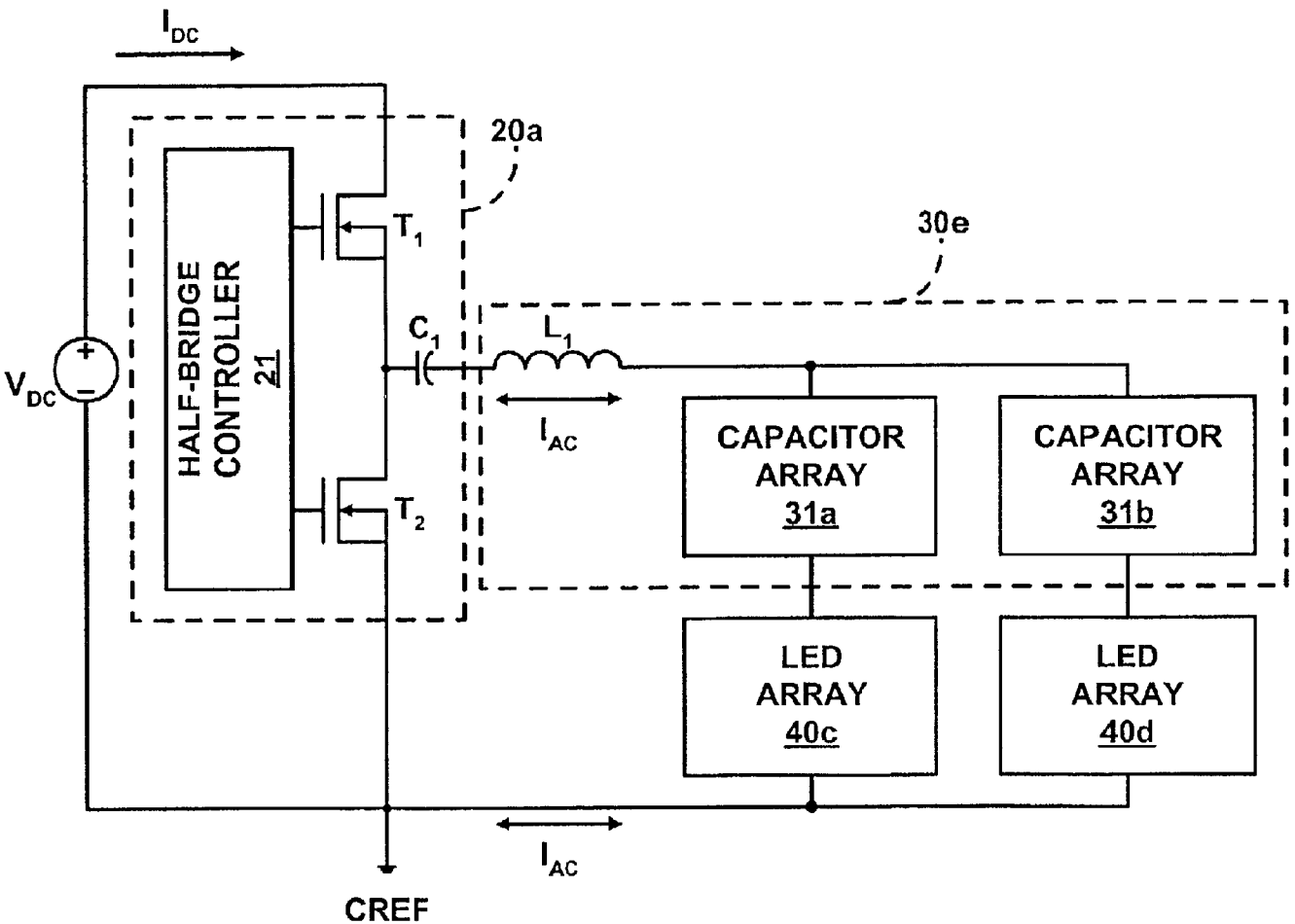
FIG. 8 illustrates a second embodiment of an illumination system in accordance with the present invention.

FIG. 8 illustrates a second embodiment of an illumination system in accordance with the present invention that combines on/off switching features as demonstrated in FIG. 5 with amplitude control features as demonstrated in FIG. 6 that can be used as an automobile rear lighting system. An impedance circuit 30*e* includes inductor $L_1$ coupled in series to a capacitive array 31*a* consisting of capacitor $C_2$, capacitor $C_3$, capacitor $C_4$ and capacitor $C_5$ as taught by the description of FIG. 5. Inductor $L_1$ as further coupled in series to a capacitive array 31*b* consisting of capacitor $C_2$, capacitor $C_3$, capacitor $C_4$, capacitor $C_5$ and capacitor $C_6$ as taught by the description of FIG. 6. HF inverter 20, impedance circuit 30*e*, and LED array 40*c* constitutes a turn signaling device whereby an operation of transistor $T_3$ as previously described herein in connection with FIG. 5 facilitates a flashing emission of light from LED array 40*c*. HF inverter 20, impedance circuit 30*e*, and LED array 40*d* constitutes a brake signaling device whereby an operation of transistor $T_3$ as previously described herein in connection with FIG. 6 facilitates an alternating bright/dim emission of light from LED array 40*d*. In this embodiment, a single inductor $L_1$ is used to minimize the size and cost of the controlling circuit.

In the present invention described herein in connection with FIGS. 1–8, those having ordinary skill in the art will appreciate HF inverter 20 and embodiments thereof combine the benefits of small size and high efficiency. Additionally, impedance circuit 30, LED array 40 and embodiments therefore utilize variable frequency, "linear" light output control based on a simple multiple array capability. Furthermore, LED array 40*d* and variations thereof allow for "step" light output and on/off switching control of multiple LED from a single driver. This type of control can be useful in operating running/stop/turn signals on an automobile or stop/caution/go signals of a traffic light among other uses.

While the embodiments of the present invention disclosed herein are presently considered to be preferred, various changes and modifications can be made without departing from the spirit and scope of the present invention. The scope of the present invention is indicated in the appended claims, and all changes that come within the meaning and range of equivalents are intended to be embraced therein.

What is claimed is:

1. A device, comprising:

a first LED array having a first anti-parallel configuration excluding any parallel connections to capacitors;

an inverter operable to provide an alternating voltage; and a first resonant impedance circuit including a first resonant inductor and a first resonant capacitor connected to said first LED array in a first series resonant, series loaded configuration having said first resonant inductor connected in series to said inverter, and said first resonant capacitor connected in series between said first resonant inductor and said first LED array, wherein said first resonant impedance circuit directs a first flow of a first alternating current through said first LED array in response to the alternating voltage having a first polarity and directs a second flow of the first alternating current through said first LED array in response to the alternating voltage having a second polarity.

2. The device of claim 1, wherein said first LED array includes at least one of a LED pair, a LED string and a LED matrix.

3. The device of claim 1, further comprising a second LED array having a second anti-parallel configuration;

wherein said first resonant impedance circuit further includes a second resonant capacitor;

wherein said first resonant inductor and said second resonant capacitor are connected to said second LED array in a second series resonant, series loaded configuration having said first resonant inductor connected in series to said inverter, and said second resonant capacitor connected in series between said first resonant inductor and said second LED array; and wherein said first resonant impedance circuit directs a third flow of a second alternating current through said second LED away in response to the alternating voltage having the first polarity and directs a fourth flow of the second alternating current through said second LED array in response to the alternating voltage having the second polarity.

4. The device of claim 1, further comprising:

a second LED array having a second anti-parallel configuration; and a second resonant impedance circuit including a second resonant inductor and a second resonant capacitor connected to said second LED array in a second series resonant, series loaded configuration having said second resonant inductor connected in series to said inverter, and said second resonant capacitor connected in series between said second resonant inductor and said second LED array, wherein said second resonant impedance circuit directs a third flow of a second alternating current through said second LED array in response to the alternating voltage having the first polarity and directs a fourth flow of the second alternating current through said second LED array in response to the alternating voltage having the second polarity.

5. A device, comprising:

a first LED array having a first anti-parallel configuration;

an inverter operable to provide an alternating voltage; and a first resonant impedance circuit including a first resonant inductor and a first resonant capacitor array connected to said first LED array in a first series resonant, series loaded configuration having said first resonant inductor connected in series to said inverter, and said first resonant capacitor array connected in series between said first resonant inductor and said first LED array, wherein said first resonant impedance circuit directs a first flow of a first alternating current through first LED array in response to the alternating voltage having a first polarity and directs a second flow of the first alternating current through said first LED array in response to the alternating voltage having a second polarity.

6. The device of claim 5, wherein said first LED array includes at least one of a LED pair, a LED string and a LED matrix.

7. The device of claim 5, wherein said first LED array includes a switch operable to control at least one of the first flow and the second flow of the first alternating current through said first LED array.

8. The device of claim 5, further comprising a second LED array having a second anti-parallel configuration;

wherein said first resonant impedance circuit further includes a second resonant capacitor array;

wherein said first resonant inductor and said second resonant capacitor array are connected to said second LED array in a second series resonant, series configuration having said first resonant inductor connected in series to said inverter, and said second resonant capacitor array connected in series between said first resonant inductor and said second LED array; and wherein said first resonant impedance circuit directs a third flow of a second alternating current through said second LED away in response to the alternating voltage having the first polarity and directs a fourth flow of the second alternating current through said second LED array in response to the alternating voltage having the second polarity.

9. The device of claim 8, wherein said first LED array includes a first switch operable to control at least one of the first flow and the second flow of the first alternating current through said first LED array; and wherein said second LED array includes a second switch operable to control at least one of the third flow and the fourth flow of the second alternating current through said second LED array.

10. The device of claim 5, further comprising:

a second LED array having a second anti-parallel configuration; and a second resonant impedance circuit including a second resonant inductor and a second resonant capacitor array connected to said second LED array in a second series resonant, series loaded configuration having said second resonant inductor connected in series to said inverter, and said second resonant capacitor array connected in series between said second resonant inductor and said second LED array, wherein said second resonant impedance circuit directs a third flow of a second alternating current through said second LED array in response to the alternating voltage having the first polarity and directs a fourth flow of the second alternating current through said second LED array in response to the alternating voltage having the second polarity.

11. The device of claim 10, wherein said first LED may includes a first switch operable to control at least one of the first flow and the second flow of the first alternating current through said first LED array; and wherein said second LED array includes a second switch operable to control at least one of the third flow and the fourth flow of the second alternating current through said second LED array.

12. A device, comprising:

a first LED array having a first anti-parallel configuration excluding any parallel connections to capacitors;

an inverter operable to provide an alternating voltage; and a first resonant impedance circuit connected to said first LED array in a first series resonant, series loaded configuration having said first resonant impedance circuit connected in series between said inverter and said first LED array, wherein said first resonant impedance circuit includes means for directing a first flow of a first alternating current through said first LED array in response to the alternating voltage having a first polarity and directing a second flow of the first alternating current through said first LED array in response to the alternating voltage having a second polarity.

13. The device of claim 12, wherein said first LED array includes at least one of a LED pair, a LED string and a LED matrix.

14. The device of claim 12, wherein said first LED array includes a switch operable to control at least one of the first flow and the second flow of the first alternating current through said first LED array.

15. The device of claim 12, further comprising a second LED array having a second anti-parallel configuration;

wherein said first resonant impedance circuit is connected to said second LED array in a second series resonant, series loaded configuration having said first resonant impedance circuit connected in series between said inverter and said second LED array; and wherein said first resonant impedance circuit includes means for directing a third flow of a second alternating current through said second LED array in response to the alternating voltage having the first polarity and directing a fourth flow of the second alternating current through said second LED array in response to the alternating voltage having the second polarity.

16. The device of claim 15, wherein said first LED array includes a first switch operable to control at least one of the first flow and the second flow of the first alternating current through said first LED array; and wherein said second LED array includes a second switch operable to control at least one of the third flow and the fourth flow of the second alternating current through said second LED array.

17. The device of claim 12, further comprising:

a second LED array having a second anti-parallel configuration; and a second resonant impedance circuit connected to said second LED array in a second series resonant, series loaded configuration having said second resonant impedance circuit connected In series between said Inverter and said second LED array, wherein said second resonant impedance circuit includes means for directing third flow of a second alternating current through said second LED array in response to the alternating voltage having the first polarity and directing a fourth flow of the second alternating current through said second LED array in response to the alternating voltage having the second polarity.

18. The device of claim 17, wherein said first LED array includes a first switch operable to control at least one of the first flow and the second flow of the first alternating current through said first LED array; and wherein said second LED array includes a second switch operable to control at least one of the third flow and the fourth flow of the second alternating current through said second LED array.

19. A device, comprising:

at least one LED array, each LED array having an anti-parallel configuration excluding any parallel connections to capacitors;

an inverter means for providing an alternating voltage; and a resonant impedance means connected to each LED array in a series resonant, series loaded configuration having said resonant impedance means connected in series between said inverter and each LED array, said resonant impedance means for directing a first flow of a first alternating current through said at least one LED array in response to the alternating voltage having a first polarity and directing a second flow of the first alternating current through said at least one LED array in response to the alternating voltage having a second polarity.

20. The device of claim 19, wherein said at least one LED array includes switching means for controlling at least one of the first flow and the second flow of the first alternating current through said at least one LED array.

21. A device, comprising:

a first LED array having a first anti-parallel configuration;

an inverter operable to provide an alternating voltage;

a first resonant impedance circuit including a first resonant inductor and a first resonant capacitor connected to said first LED array in a first series resonant, series loaded configuration having said first resonant inductor connected in series to said inverter, and said first resonant capacitor connected in series between said first resonant inductor and said first LED array, wherein said first resonant impedance circuit directs a first flow of a first alternating current through said first LED array in response to the alternating voltage having a first polarity and directs a second flow of the first alternating current through said first LED array in response to the alternating voltage having a second polarity; and a second LED array having a second anti-parallel configuration, wherein said first resonant impedance circuit further includes a second resonant capacitor, wherein said first resonant inductor and said second resonant capacitor are connected to said second LED array in a second series resonant, series loaded configuration having said first resonant inductor connected in series to said inverter, and said second resonant capacitor connected in series between said first resonant inductor and said second LED array, and wherein said first resonant impedance circuit directs a third flow of a second alternating current through said second LED array in response to the alternating voltage having the firm polarity and directs a fourth flow of the second alternating current through said second LED array in response to the alternating voltage having the second polarity.

22. A device, comprising:

a first LED array having a first anti-parallel configuration;

an inverter operable to provide an alternating voltage;

a first resonant impedance circuit including a first resonant inductor and a first resonant capacitor connected to said first LED array in a first series resonant, series loaded configuration having said first resonant inductor connected in series to said inverter, and said first resonant capacitor connected in series between said first resonant inductor and said first LED array, wherein said first resonant impedance circuit directs a first flow of a first alternating current through said first LED array in response to the alternating voltage having a first polarity and directs a second flow of the first alternating current through said first LED array in response to the alternating voltage having a second polarity;

a second LED array having a second anti-parallel configuration; and a second resonant impedance circuit including a second resonant inductor and a second resonant capacitor connected to said second LED array in a second series resonant, series loaded configuration having said second resonant inductor connected in series to said inverter, and said second resonant capacitor connected in series between said second resonant inductor and said second LED array, wherein said second resonant impedance circuit directs a third flow of a second alternating current through said second LED array in response to the alternating voltage having the first polarity and directs a fourth flow of the second alternating current through said second LED array in response to the alternating voltage having the second polarity.

23. A device, comprising:

a first LED array having a first anti-parallel configuration;

an inverter operable to provide an alternating voltage; and a first resonant impedance circuit connected to said first LED array in a first series resonant, series loaded configuration having said first resonant impedance circuit connected in series between said inverter and said first LED array, wherein said first resonant impedance circuit includes means for directing a first flow of a first alternating current through said first LED array in response to the alternating voltage having a first polarity and directing a second flow of the first alternating current through said first LED array in response to the alternating voltage having a second polarity; and a second LED array having a second anti-parallel configuration, wherein said first resonant impedance circuit is connected to said second LED array in a second series resonant, series loaded configuration having said first resonant impedance circuit connected in series between said inverter and said second LED array, and wherein said first resonant impedance circuit includes means for directing a third flow of a second alternating current through said second LED array in response to the alternating voltage having the first polarity and directing a fourth flow of the second alternating current through said second LED array in response to the alternating voltage having the second polarity.

24. The device of claim 23, wherein said first LED array includes a first switch operable to control at least one of the first flow and the second flow of the first alternating current through said first LED array.

25. The device of claim 24, wherein said second LED array includes a second switch operable to control at least one of the third flow and the fourth flow of the second alternating current through said second LED array.

26. A device, comprising:

a first LED array having a first anti-parallel configuration;

an inverter operable to provide an alternating voltage; and a first resonant impedance circuit connected to said first LED array in a first series resonant, series loaded configuration having said first resonant impedance circuit connected in series between said inverter and said first LED array, wherein said first resonant impedance circuit includes means for directing a first flow of a first alternating current through said first LED array in response to the alternating voltage having a first polarity and directing a second flow of the first alternating current through said first LED array in response to the alternating voltage having a second polarity;

a second LED array having a second anti-parallel configuration; and a second resonant impedance circuit connected to said second LED array in a second series resonant, series loaded configuration having said second resonant impedance circuit connected in series between said inverter and said second LED array, wherein said second resonant impedance circuit includes means for directing third flow of a second alternating current through said second LED array in response to the alternating voltage having the first polarity and directing a fourth flow of the second alternating current through said second LED array in response to the alternating voltage having the second polarity.

27. The device of claim 26, wherein said first LED array includes a first switch operable to control at least one of the first flow and the second of the first alternating current through said first LED array.

28. The device of claim 27, wherein said second LED array includes a second switch operable to control at least one of the third flow and the fourth flow of the second alternating current through said second LED array.

* * * * *